US012607395B2

(12) United States Patent
Hiemeyer et al.

(10) Patent No.: US 12,607,395 B2
(45) Date of Patent: Apr. 21, 2026

(54) HEAT INSULATING ELEMENT

(71) Applicant: LIEBHERR-HAUSGERATE OCHSENHAUSEN GMBH, Ochsenhausen (DE)

(72) Inventors: Jochen Hiemeyer, Karlstadt (DE); Lukas Limbach, Veitshoechheim (DE); Michael Freitag, Thuengersheim (DE)

(73) Assignee: LIEBHERR-HAUSGERÄTE OCHSENHAUSEN GMBH, Ochsenhausen (DE)

( * ) Notice: Subject to any disclaimer, the term of this patent is extended or adjusted under 35 U.S.C. 154(b) by 350 days.

(21) Appl. No.: 18/037,089

(22) PCT Filed: Nov. 15, 2021

(86) PCT No.: PCT/EP2021/081706
§ 371 (c)(1),
(2) Date: May 16, 2023

(87) PCT Pub. No.: WO2022/112041
PCT Pub. Date: Jun. 2, 2022

(65) Prior Publication Data

US 2023/0417474 A1 Dec. 28, 2023

(30) Foreign Application Priority Data

Nov. 30, 2020 (DE) ..... 10 2020 131 618.6
Jan. 13, 2021 (DE) ..... 10 2021 100 454.3

(51) Int. Cl.
*F25D 23/02* (2006.01)

(52) U.S. Cl.
CPC ..... *F25D 23/02* (2013.01); *F25D 2201/14* (2013.01)

(58) Field of Classification Search
CPC .... F25D 23/02; F25D 2201/14; F25D 23/065; F25D 2400/18; E05Y 2900/31; Y02B 40/00; E04B 1/803
See application file for complete search history.

(56) References Cited

U.S. PATENT DOCUMENTS 2,816,331 A * 12/1957 Moore ..... F25D 23/082 52/784.15
4,740,042 A * 4/1988 Stich ..... F25D 23/04 312/405.1

(Continued)

FOREIGN PATENT DOCUMENTS

CN 107257906 A 10/2017
CN 110418867 A 11/2019

(Continued)

OTHER PUBLICATIONS

Office Action issued in corresponding Russian Patent Application No. 2023117104/10(036533) dated Dec. 21, 2023 (7 pages).

(Continued)

*Primary Examiner* — Hanh V Tran
(74) *Attorney, Agent, or Firm* — Kilyk & Bowersox, P.L.L.C.

(57) ABSTRACT

The invention relates to a heat insulating element (1) comprising: a plate-type main part (2) with a first flat face and a second flat face and comprising a vacuum insulating body (3), in particular a foil-encased vacuum insulating body which is arranged between the first flat face and the second flat face, wherein the first flat face and the second flat face are made of a respective cover layer (4, 5), and on at least one of the two flat faces, the corresponding cover layer (4) is only partially connected to the vacuum insulating body (3), in particular in an adhered or melted manner. The invention is characterized in that the cover layer (4) which is only partially connected has a relief structure (6) in all of, (Continued)

Figure 1:
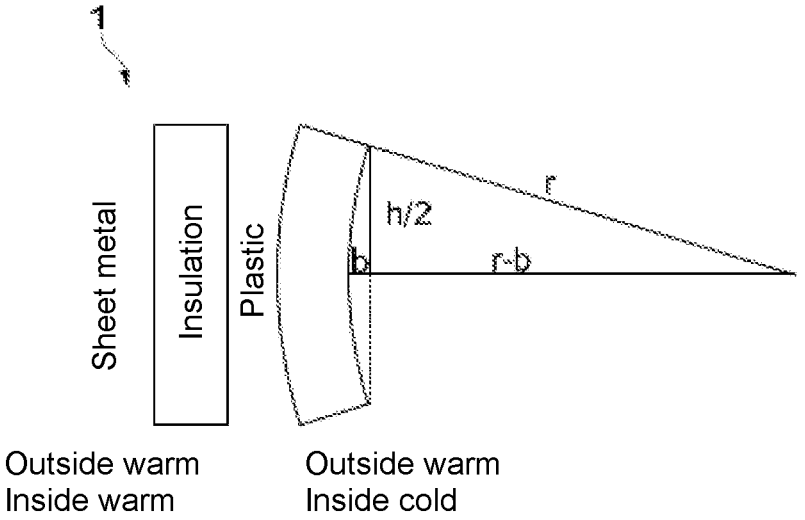

a plurality of, or the majority of the regions which are not connected to the vacuum insulating body (3), said relief structure being designed to compensate for a thermal expansion or a thermal contraction.

19 Claims, 2 Drawing Sheets

(56) References Cited

U.S. PATENT DOCUMENTS

| | | | | | |
|---|---|---|---|---|---|
| 4,837,388 | A * | 6/1989 | Kugelmann | B21D 13/02 | 428/72 |
| 5,082,335 | A * | 1/1992 | Cur | F25D 23/062 | 62/DIG. 13 |
| 5,107,649 | A * | 4/1992 | Benson | E04C 2/34 | 52/794.1 |
| 5,157,893 | A * | 10/1992 | Benson | B64G 1/22 | 52/789.1 |
| 5,445,857 | A * | 8/1995 | Nowobilski | F27D 1/06 | 428/76 |
| 6,037,033 | A * | 3/2000 | Hunter | B32B 3/28 | 428/184 |
| 6,138,432 | A * | 10/2000 | Banicevic | F25D 23/02 | 312/405.1 |
| 10,274,247 | B2 * | 4/2019 | Jeong | F25D 23/066 | |
| 11,274,874 | B2 * | 3/2022 | Burke | F25D 23/028 | |
| 2010/0218547 | A1 | 9/2010 | Rothmund et al. | | |
| 2015/0377546 | A1 | 12/2015 | Freitag et al. | | |
| 2017/0276419 | A1 * | 9/2017 | Jeong | F25D 11/006 | |
| 2017/0327297 | A1 | 11/2017 | Hiemeyer et al. | | |
| 2019/0137166 | A1 * | 5/2019 | Dherde | F25D 23/066 | |
| 2019/0316345 | A1 | 10/2019 | Caps et al. | | |
| 2022/0397334 | A1 * | 12/2022 | Weickert | F25D 23/028 | |

FOREIGN PATENT DOCUMENTS

| | | | | | |
|---|---|---|---|---|---|
| DE | 102013105819 | A1 | | 12/2014 | |
| EP | 0434225 | A1 | | 6/1991 | |
| EP | 2363337 | A1 | | 9/2011 | |
| JP | H06306966 | A | * | 11/1994 | |
| JP | H0768681 | A | * | 3/1995 | F27D 1/06 |
| JP | 2010127463 | A | * | 6/2010 | |
| JP | 2010190257 | A | | 9/2010 | |
| JP | 2013050267 | A | | 3/2013 | |
| KR | 2011028423 | A | * | 3/2011 | |
| RU | 2473852 | C2 | | 1/2013 | |
| RU | 2662780 | C2 | | 7/2018 | |
| RU | 197942 | U1 | | 6/2020 | |
| WO | WO-2012015095 | A1 | * | 2/2012 | F16L 59/075 |
| WO | 2014183622 | A1 | | 11/2014 | |
| WO | 2020158012 | A1 | | 8/2020 | |
| WO | WO-2020157825 | A1 | * | 8/2020 | F25D 23/06 |

OTHER PUBLICATIONS

International Search Report and Written Opinion (with English translation of International Search Report) issued in corresponding International Patent Application No. PCT/EP2021/081706 mailed Mar. 1, 2022 (18 pages).

Office Action issued in corresponding German Patent Application No. 10 2021 100 454.3 dated Sep. 1, 2021 (6 pages).

Office Action issued in corresponding Chinese Patent Application No. 202180079735.6 dated Mar. 27, 2025 (19 pages).

* cited by examiner

HEAT INSULATING ELEMENT

This application is a National Stage Application of PCT/EP2021/081706, filed Nov. 15, 2021, which in turn claims priority to German Patent Application No. 10 2020 131 618.6 filed Nov. 30, 2020 and German Patent Application No. 10 2021 100 454.3 filed Jan. 13, 2021.

The invention relates to a heat insulating element for thermal insulation. Such heat insulating elements are in particular used in refrigerator units or thermal boxes, for example for refrigerator units and/or freezer units It is of great importance with these units that the insulation from an inner container to the outside is of as high a quality as possible so that the energy required for the cooling or heating can be kept to a level that is as low as possible.

Heat insulating elements are often used as sandwich elements composed of an insulating material and outwardly arranged top layers. This is in particular known from insulating elements on a polyurethane foam basis in which the foam takes over the insulating function and the good adhesion with the top layers and thereby simultaneously also enables high mechanical stability.

Steel, aluminum, or plastics are typically used as top layers. It is advantageous for the top layer to consist of plastic at least in the marginal zone of the sandwich element to avoid heat bridges. In cost efficient structures such as domestic refrigeration appliances, the total inner space is typically designed with a plastic top layer.

It is problematic with this that the coefficient of thermal expansion of plastics is typically considerably higher than that of steel. The coefficient of expansion of polystyrene is thus approximately $7*10^{-5}$ [1/K] and that of steel is $1.2*10^{-5}$ [1/K]. With the temperature difference of approximately 43 K present in freezers, a thermal shrinkage of 0.3% results for polystyrene, i.e. with a large unit having a height of 2 m, the inner container would shrink in length by 6 mm. This shrinkage is prevented by the housing, whereby, however, stresses arise in the heat insulating element that have to be prevented by the technical design.

This stress is reduced at least in part by a deflection of the elements with planar elements. This phenomenon is in particular known with doors of domestic refrigeration appliances. If a freezer door having a height of 170 cm and a thickness of 50 mm were to be designed only with a heat insulating element in a sandwich design in which one top layer comprises a flat metal sheet on one side and the top layer of the other side comprises a flat plastic plate, the door would be deflected by approximately 22 mm at the center on the cold side. This procedure is illustrated in FIG. 1.

In reality, this deflection is reduced by the stiffness of the metal door sheet. This sheet metal stiffness can, however, not be increased as desired since the height of the lateral sheet metal lip (that represents the main influence for the sheet metal stiffness) is limited for construction reasons and the sheet metal thickness cannot be increased as desired for technical cost reasons. It is therefore known from the prior art to additionally work with relief grooves on the plastic side. A further possibility of reducing the door deflection known from the prior art comprises applying sheet metal strips to the plastic side that reduce the shrinkage of the plastic—and thus the door deflection—due to the smaller thermal expansion. The increased technical production effort and the additional material input for the sheet metal strips are, however, disadvantageous here.

The problem area is known for conventional refrigeration appliance doors that have PU foam as the insulating material. FIG. 2 shows different aspects and solution approaches from the prior art. PU foam as the insulating material is, however, limited with respect to its possibilities with respect to an insulating effect and is more and more complemented by or replaced with vacuum insulation or film covered vacuum insulation bodies.

Vacuum insulation bodies having a high barrier film as a gas impermeable cover are state of the art and are increasingly widespread in the implementation of heat insulating elements. The use of a barrier film makes a sufficient sealing possible with respect to gas particles that diffuse in without causing too large a heat bridge in the cover while so doing or being susceptible to thermal or mechanical stresses.

The thin film is, however, sensitive to mechanical damage and has to be protected in use. In addition, the vacuum insulation body can take up mechanical forces very easily in a sandwich compound structure since the stiffness of the pressurized insulation body is typically of a similar or greater amount than the stiffness of conventional insulating materials, in particular of plastic foams.

It is the aim of the present invention to relieve or overcome the problems addressed above of a deflection of a thermal insulating element caused by thermal differences. This is done using a heat insulating element that has all the features of claim 1.

In accordance with the invention, the heat insulating element comprises a plate-like base body having a first planar side and a second planar side and a vacuum insulation body that is arranged between the first planar side and the second planar side, wherein the first planar side and the second planar side are formed by a respective top layer and the corresponding top layer is only partially connected, in particular adhesively bonded or fused, to the vacuum insulation body at at least one of the two planar sides. The invention is characterized in that the only partially connected top layer has a relief structure in all the regions, in a plurality of the regions, or the majority of the regions not connected to the vacuum insulation body that is configured to compensate a thermal expansion or a thermal contraction.

Since the top layer is now not connected or adhesively bonded to the vacuum insulation body over the full area, the top layer can prevent a deflection generated by a temperature difference at the two top layers in the regions not adhesively bonded to the vacuum insulation body. This is done in that the thermal contraction or the thermal expansion is implemented by an expansion or contraction of the relief structure that is not connected or adhesively bonded to the vacuum insulation body. It is thus possible that the thermal expansion or the thermal contraction of a top layer is reduced by a change in the relief structure without any real deflection of the vacuum insulation body or of the heat insulating element arising.

The vacuum insulation body can here be a film covered vacuum insulation body that has perlite as the core material, for example.

Vacuum insulation bodies having perlite as the core material display a lower thermal expansion in the insulating layer ($<1*10^{-5}$ [1/K]) than PU foam (approximately $7*10^{-5}$ [1/K]). The advantage of the smaller thermal expansion is, however, not only present with perlite as the filler material, but rather applies to all film covered vacuum insulation bodies since, unlike foaming insulation bodies, they are not self-adhesive with the top layer. There is therefore also the advantage here that a sandwich structure in insulating elements having a film covered vacuum insulation body can be generated by a manufacturing process in which partial adhesive bonds between the top layer and the vacuum insulation body can be implemented without problem.

Provision is made in accordance with an advantageous modification of the present invention that the film covered vacuum insulation body is received in the manner of a sandwich between a first top layer and a second top layer, preferably with the film covered vacuum insulation body being directly connected to both top layers.

Provision can be made in accordance with a further optional modification of the invention that the top layer comprises plastic, steel, and/or aluminum or consists of one of these materials.

A heat insulating element is typically designed with top layers that are produced from different materials. A refrigerator door is outwardly provided with a steel sheet as a rule due to stability requirements and to an improved optical impression, whereas the inner side of this refrigerator door is composed of plastic. The heat insulating element in such a door is therefore made with an inner top layer of plastic and an outer top layer of a steel sheet.

Provision can be made in accordance with a further development of the present invention that the top layer and the vacuum insulation body are partially connected to one another via a plurality of connection regions that are spaced apart from one another.

A respective relief structure that is formed by the top layer region not connected to the vacuum insulation body is provided between the connection regions. Since only parts of the top layer are connected or adhesively bonded to the vacuum insulation body, the non-connected sections of the top layer cannot take up and transfer the thermal expansion or contraction so that the forces that result in a deflection and that act on the vacuum insulation body from the top layer are reduced.

Provision can advantageously be made in this respect that the spacing of the connection regions is smaller than 100 mm, preferably smaller than 75 mm, and more preferably smaller than 50 mm.

The provision of a plurality of connection regions that are spaced apart from one another by less than 100 mm contributes to the stability of the top layer and provides that no negative impression arises even on a haptic check of the top layer formed in this manner, Provision can furthermore be made in accordance with the invention that all the connection regions, a plurality of the connection regions, or the majority of the connection regions are formed in a strip-like manner at the top layer and preferably extend in parallel with one another.

A reliable connection between the top layer and the vacuum insulation body that can be simply implemented industrially is produced due to the strip-like design of the connection regions. If the connection regions are furthermore also still aligned in parallel with one another, this represents a further facilitation in the manufacture of the heat insulating element in accordance with the invention since a plurality of connection strips can be prepared or applied in a single workstep performed by machine or by hand. An advantageous visual design of the top layer is additionally produced by the parallel alignment of the connection strips and of the arrangement of the relief structure arranged between the connection strips that is likewise in parallel from this.

Provision can be made in accordance with a further advantageous variant of the invention that the connection regions are arranged in a regular structure between the top layer and the vacuum insulation body, with a spacing between the connection regions provided between the top layer and the vacuum insulation body preferably being the same.

The regular arrangement of the connection regions between the top layer and the vacuum insulation body provides a stability that remains unchanged over the whole surface of the top layer and a particularly advantageous visual impression.

Provision is preferably made in accordance with the invention that the relief structure is shaped as convex with respect to the vacuum insulation body and is preferably designed as bell-shaped or hood-shaped in a sectional view.

Due to the design of the relief structure as convex with respect to the vacuum insulation body, the former is able to compensate thermal expansion or thermal contraction without introducing an excessive amount of force into the vacuum insulation body connected to the top layer in so doing. This is done in that the convex relief structure rises or falls, that is expands or contracts, with respect to the substantially planar surface of the vacuum insulation body.

Provision can furthermore be made here that the maximum spacing from an inner side of the relief structure rising from the vacuum insulation body is smaller than five times, preferably smaller than three times, the thickness of the top layer. Provision can be made here that this spacing from the vacuum insulation body to the inner side of the top layer is at least the thickness of the top layer.

Provision can be made in accordance with a further advantageous embodiment of the present invention that a gap, in particular an air gap, is provided between the relief structure and the vacuum insulation body.

This gap, that permits an entry and an exit of a fluid on a thermal expansion or on a thermal contraction, makes possible the movement of the top layer or of the relief structure toward or away from the vacuum insulation body.

Provision can furthermore be made in accordance with the present invention that a surface ratio of non-connected regions between the top layer and the vacuum insulation body is larger than the surface ratio of connected regions between the top layer and the vacuum insulation body, preferably larger than twice that of the connected regions.

The present invention further comprises a door of a refrigerator unit and/or a freezer unit, wherein the door or the lid comprises a heat insulating element in accordance with one of the above-discussed variants or consists of such a heat insulating element.

Provision can be made here that the connection regions extend in a strip-like manner transversely to the longitudinal direction of the door and preferably over the entire width of the door. The deflection of a door in the longitudinal direction, that is considered problematic, is in particular hereby prevented since the thermal contraction that occurs, for example, on the top layer facing the inner side of a refrigerator is taken up by the at least one relief structure.

Provision can be made here in accordance with a further optional development that the relief structures of the heat insulating element are provided at a side of the door facing the interior of the refrigerator unit and/or freezer unit. They can represent the surface of the door there.

Provision can likewise preferably be made that a top layer of the heat insulating element that is not provided with relief structures and that is preferably produced from aluminum or a steel is arranged at an outer side of the door that faces an outer of the refrigerator unit and/or freezer unit.

The provision of an outer contour of a door that is produced from sheet steel or an aluminum provides a high quality visual impression and additionally contributes to the outer side not being sensitive to blows or other environmental influences.

It is pointed out at this point that the terms "a" and "one" do not necessarily refer to exactly one of the elements, even though this represents a possible embodiment, but can also designate a plurality of elements. The use of the plural equally also includes the presence of the element in question in the singular and, conversely, the singular also includes a plurality of the elements in question.

Figure 2A:
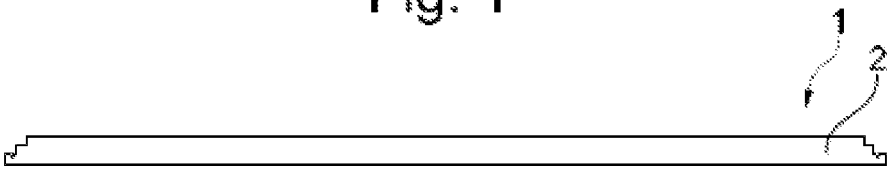
Figure 2B:
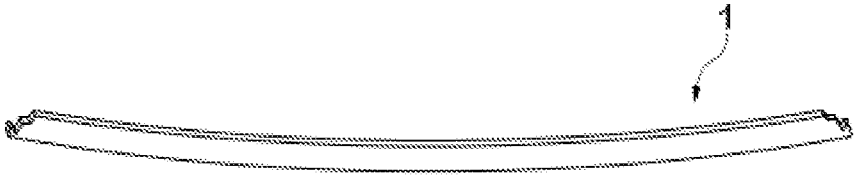

Further advantages, features, and details of the present invention will become clear on the basis of the description of the Figures. There are shown:

FIG. 1: an illustration to demonstrate a deflection of a heat insulating element with two top layers and insulation arranged therebetween;

FIGS. 2*a-b*: a lateral representation of a heat insulating element in accordance with the prior art in a relaxed state and in a deflected state caused due to thermal contraction.

Figure 3A:
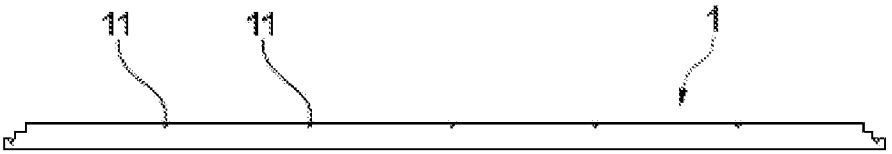
Figure 3B:
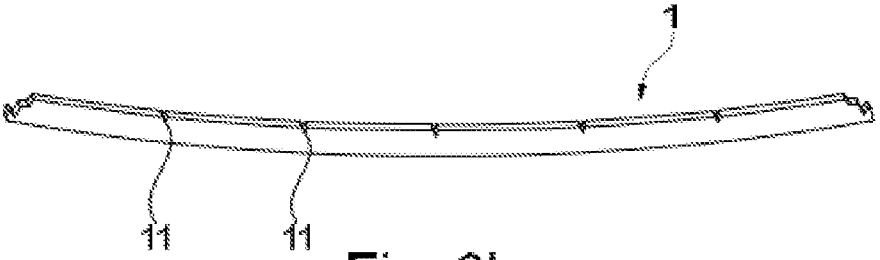
Figure 4:
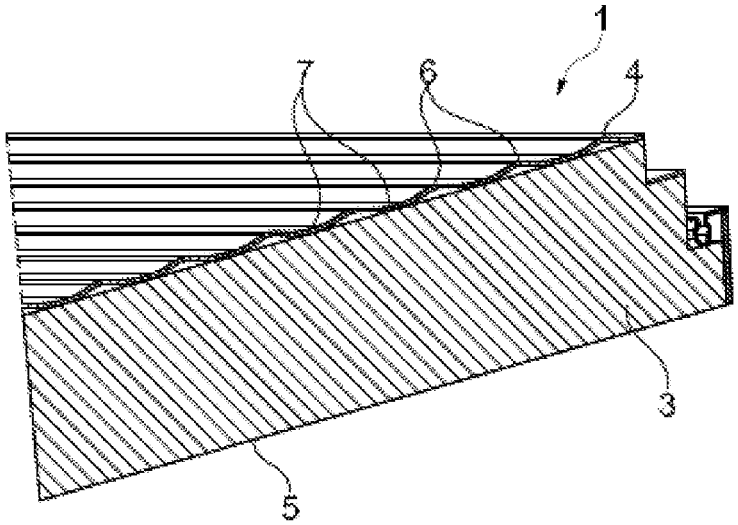
Figure 5:
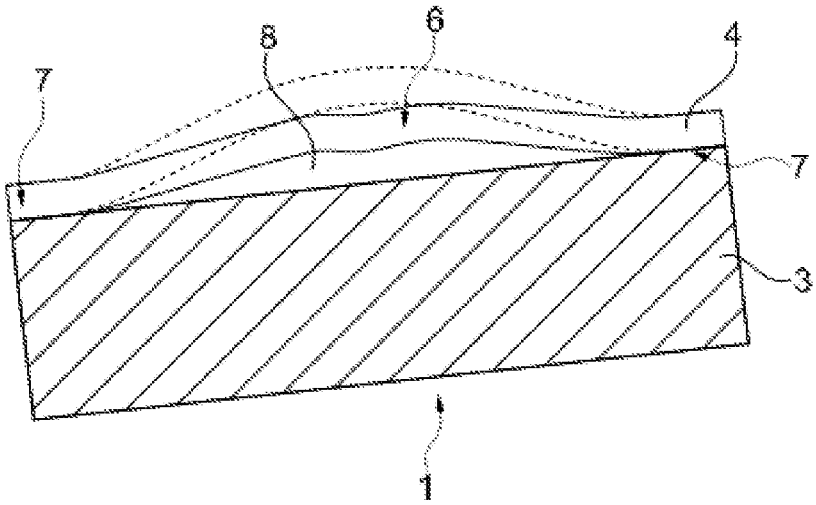

FIGS. 3*a-b*: a lateral representation of a heat insulating element in accordance with the prior art in a relaxed state and in a deflected state caused due to thermal contraction;

FIG. 4: a sectional view of the plug holder in a fastened state at a refrigerator unit and/or a freezer unit; and FIG. 5: an enlarged detail of the vacuum insulation body in a sectional view.

FIG. 1 shows an insulation body 1 in a sandwich design whose outer top layers are sheet metal or plastic. The outer side is arranged at the left in the Figure here so that the top layer of sheet metal is arranged outwardly and the top layer of plastic inwardly. If such an insulation body is now cooled at an inner side, whereas the outer side remains at a constant temperature level, the deflection that is shown is produced.

FIG. 2*a* and FIG. 2*b* show a side view of a conventional insulation body, with the inner side arranged at the top in the representation being once exposed to the same temperature level as the outer side arranged at the bottom in the representation and being exposed in another case to a considerably lower temperature level so that a deflection occurs (as in FIG. 2*b*).

It was already known from the prior art to provide grooves 11 extending transversely to the longitudinal direction of an element to alleviate the deflection. Such a heat insulating element 1 having transversely extending grooves 11 is shown in FIGS. 3*a* and 3*b* with reference to which it can be recognized that the deflection is smaller than that in FIG. 2*b*. The grooves 11 here provide increased stability at the top layer of a heat insulating element 1 facing toward the inner side so that a thermal contraction has less effect.

FIG. 4 shows a sectional view of a heat insulating element 1 in accordance with the invention. A heat insulation body 3 that can be a film covered vacuum insulation body 3 can be recognized that is arranged between the two top layers 4, 5. Provision can preferably also be made here that perlite is used as the core material since it has been proven to be particularly advantageous in the formation of film covered vacuum insulation bodies.

The top layer 4 here typically faces a cooler space than the top layer 5. It can be recognized that the top layer 4 is not connected or adhesively bonded to the vacuum insulation body 3 over the full area, but is rather as a rule characterized by non-connected regions. These regions represent relief structures 6 that are adapted to take up thermal expansion or thermal contraction. The connection regions 7 in which the top layer 4 is connected or adhesively bonded to the vacuum insulation body 3 here extend in strip form and equidistantly over the planar side of the vacuum insulation body 3.

Starting from a connection region 7, the relief structure 6 is a design, in a sectional view, consisting of two limbs, with each of the limbs being of approximately the same length and together including an obtuse angle.

An advantageous visual impression of the top layer 4 is produced by the regularity of the connection regions or of the relief structures arranged therebetween.

FIG. 5 shows an enlarged detail of the vacuum insulation body 1 in a sectional view so that the region between two adjacent connection regions 7 and the relief structure 6 arranged therebetween can be recognized. The relief structure 6 here is shown in solid lines in a thermally contracted state, whereas a state of the relief structure 6 or of the corresponding top layer 4 relaxed in comparison therewith is shown by a dotted lune. It can be recognized that the relief structure 6 is contracted in a cooled state of the top layer 4, which is shown by a reduction of the spacing of the inner side of the relief structure 6 from the vacuum insulation body 3. The hood-shaped or bell-shaped contour of the relief structure 6 is drawn closer to the facing surface of the vacuum insulation body 3 by the thermal contraction.

It is advantageous here that the longitudinal change that has been caused by a temperature change and that does not occur on the other side of the vacuum insulation body 3 can be compensated without a deflection of the vacuum insulation body 3 occurring. The connection or adhesive bonding of the top layer 4 that is not over the full area permits a thermal contraction in the relief structure 6 so that the forces normally induced in the vacuum insulation body 3 here do not occur.

The invention claimed is:

1. A heat insulating element comprising:

a plate-like base body having a first planar side and a second planar side; and a film covered vacuum insulation body that is arranged between the first planar side and the second planar side, wherein the first planar side and the second planar side are formed by a respective top layer, wherein the corresponding top layer at at least one of the two planar sides is only partially connected, to the film covered vacuum insulation body, the only partially connected top layer has a relief structure in all the regions, in a plurality of the regions, or the majority of the regions not connected to the film covered vacuum insulation body that is configured to compensate a thermal expansion or a thermal contraction, and a surface ratio of non-connection regions between the top layer and the film covered vacuum insulation body is larger than the surface ratio of connection regions between the top layer and the film covered vacuum insulation body.

2. The heat insulating element in accordance with claim 1, wherein the film covered vacuum insulation body is received in a sandwich-like manner between a first top layer and a second top layer.

3. The heat insulating element in accordance with claim 1, wherein the top layer comprises plastic, steel, and/or aluminum or consists of one of these materials or of a combination thereof.

4. The heat insulating element in accordance with claim 1, wherein the top layer and the film covered vacuum insulation body are partially connected to one another via the connection regions that are spaced apart from one another.

5. The heat insulating element in accordance with claim 4, wherein the spacing of the connection regions is smaller than 100 mm.

6. The heat insulating element in accordance with claim 4, wherein all the connection regions, a plurality of the connection regions, or the majority of the connection regions are formed in a strip-like manner at the top layer.

7. The heat insulating element in accordance with claim 4, wherein the connection regions are arranged in a regular structure between the top layer and the film covered vacuum insulation body, with a spacing between the connection regions provided between the top layer and the film covered vacuum insulation body.

8. The heat insulating element in accordance with claim 1, wherein the relief structure is shaped as convex with respect to the film covered vacuum insulation body.

9. The heat insulating element in accordance with claim 4, wherein the spacing of the connection regions is smaller than 50 mm.

10. The heat insulating element in accordance with claim 4, wherein all the connection regions, a plurality of the connection regions, or the majority of the connection regions are formed in a strip-like manner at the top layer extend in parallel with one another.

11. The heat insulating element in accordance with claim 8, wherein the maximum spacing from an inner side of the relief structure rising from the film covered vacuum insulation body is smaller than five times the thickness of the top layer.

12. The heat insulating element in accordance with claim 1, wherein a gap is provided between the relief structure and the film covered vacuum insulation body.

13. A door of a refrigerator unit and/or a freezer unit, wherein the door or the lid comprises a heat insulating element in accordance with claim 1.

14. The door in accordance with claim 13, wherein the connection regions extend in a strip-like manner transversely to the longitudinal direction of the door.

15. The door in accordance with claim 13, wherein the relief structure of the heat insulating element are provided at a side of the door facing the interior of the refrigerator unit and/or freezer unit.

16. The door in accordance with claim 13, wherein a top layer of the heat insulating element that is not provided with the relief structure and that is produced from aluminum or a steel is arranged at an outer side of the door that faces an exterior of the refrigerator unit and/or freezer unit.

17. The heat insulating element in accordance with claim 1, wherein the corresponding top layer at at least one of the two planar sides is adhesively bonded or fused, to the film covered vacuum insulation body.

18. The heat insulating element in accordance with claim 1, wherein the film covered vacuum insulation body is received in a sandwich-like manner between a first top layer and a second top layer with the film covered vacuum insulation body being directly connected to both top layers.

19. The heat insulating element in accordance with claim 1, wherein the relief structure is shaped as convex with respect to the film covered vacuum insulation body and is designed as bell-shaped or hood-shaped in a sectional view.

* * * * *